United States Patent [19]

Mukoyoshi et al.

[11] Patent Number: 4,997,807

[45] Date of Patent: Mar. 5, 1991

[54] IMAGE-RECEIVING SHEET FOR THERMAL DYE-TRANSFER RECORDING

[75] Inventors: Shunichiro Mukoyoshi; Tsunefumi Yamori, both of Hyogo, Japan

[73] Assignee: Kanzaki Paper Mfg. Co., Ltd., Tokyo, Japan

[21] Appl. No.: 427,695

[22] Filed: Oct. 27, 1989

[30] Foreign Application Priority Data

Oct. 31, 1988 [JP] Japan ..... 63-276748
May 26, 1989 [JP] Japan ..... 64-133398

[51] Int. Cl.[5] ..... B41M 5/035; B41M 5/26

[52] U.S. Cl. ..... 503/227; 8/471; 428/195; 428/500; 428/913; 428/914

[58] Field of Search ..... 8/471; 428/195, 913, 428/914, 500; 503/227

[56] References Cited

FOREIGN PATENT DOCUMENTS 57-107885 7/1982 Japan ..... 503/227
58-212994 12/1983 Japan ..... 503/227
59-165688 9/1984 Japan ..... 503/227
60-34898 2/1985 Japan ..... 503/227
60-212394 10/1985 Japan ..... 503/227
61-237694 10/1986 Japan ..... 503/227
62-116189 5/1987 Japan ..... 503/227
62-173295 7/1987 Japan ..... 503/227
3221091 9/1988 Japan ..... 503/227

*Primary Examiner*—Bruce H. Hess
*Attorney, Agent, or Firm*—Finnegan, Henderson, Farabow, Garrett, and Dunner

[57] ABSTRACT

An image-receiving sheet for thermal dye-transfer recording using a sublimable dye is disclosed, comprising a support having thereon an image-receiving layer for receiving a transferred image from a coloring material-transferring sheet, wherein said image-receiving layer is a layer formed by coating a substantially solvent-free coating composition comprising (A) a macromonomer dyeable with a sublimable dye and containing a radical polymerizable functional group at one terminal of the molecular chain thereof, said macromonomer being solid at room temperature, dissolved in (B) a liquid radiation-curable monomer and/or oligomer on a support and irradiating the coat with radiation. The image-receiving sheet has high surface gloss, undegoes no blocking with the coloring material-transferring sheet, and provides a recorded image having high density and excellent storage stability.

8 Claims, No Drawings

IMAGE-RECEIVING SHEET FOR THERMAL DYE-TRANSFER RECORDING

FIELD OF THE INVENTION

This invention relates to an image-receiving sheet for thermal dye-transfer recording using a heat-sublimable dye. More particularly, it relates to an image-receiving sheet which has high gloss, undergoes no blocking, and provides a recorded image having high density and excellent storage stability.

BACKGROUND OF THE INVENTION

In recent years, a full color recording system for directly recording an image photographed with a video camera, an image on a TV, a video tape recorder, a video disk, a computer, etc. on a recording material has been extensively developed. In particular, attention has been aroused on a recording system in which a support coated with a coloring material which is melted, evaporated, or sublimated by application of heat is superposed on a recording sheet (image-receiving sheet), and the coloring material is heated with a thermal head according to recording signals and then transferred to the recording sheet to form an image through adhesion, adsorption, or dye-fixing. One of the admitted characteristics of this recording system is that plain paper or a synthetic resin film, etc. may be used as the image-receiving sheet.

However, when plain paper or a resin film is used as the image-receiving sheet, the dye-fixing, in particular, is difficult to accomplish. As a result, not only is the resulting recorded image low in color density, but serious fading occurs with time.

It has been therefore suggested to coat a support of an image-receiving sheet with a thermoplastic resin, e.g., a polyester resin, to form an image-receiving layer. However, since a thermal recording head of a thermal dye-transfer recording device is generally heated to 200° C. or higher, an ink binder in the coloring material-transferring sheet and the thermoplastic resin in the image-receiving layer are softened or melted by heat to cause fusion therebetween. As a result, the both sheets are difficult to peel apart after recording or the ink layer itself of the coloring material-transferring sheet is transferred to the image-receiving sheet (this phenomenon is hereinafter referred to as blocking).

In order to prevent fusion between the coloring material-transferring sheet and the image-receiving sheet, it has been proposed to incorporate a pigment into the resin constituting the image-receiving layer to rough the surface of the image-receiving layer as disclosed in JP-A-57-107885 (the term "JP-A" as used herein means an "unexamined published Japanese Patent Application"); to coat a release agent, e.g., silicone grease, on the image-receiving layer as disclosed in JP-A-59-165688; or to incorporate a release agent, e.g., a silicon compound, into the image-receiving layer as disclosed in JP-A-60-34898, JP-A-60-212394, and JP-A-61-237694.

In the former method using a pigment, however, contact between the coloring material-transferring sheet and the image-receiving sheet at the time of dye transfer is insufficient due to the surface roughness, resulting in reduction of image density or color unevenness. In addition, the dye adhered onto the surface of the pigment tends to stain other materials, such as paper. The latter method using a release agent is also disadvantageous in that the transferred dye is affected by the release agent, causing smearing of the recorded image or reduction of image density.

Other approaches include a method in which a mixture of a thermoplastic resin and a radical polymerizable compound is cured to form an image-receiving layer having improved heat resistance as disclosed in JP-A-58-212994 and a method in which a crosslinked heat-resistant release layer is provided on an image-receiving layer as disclosed in JP-A-62-116189. These methods have turned out, however, only to provide insufficient recording density if the curing or crosslinking is conducted to such a degree enough to prevent blocking.

Moreover, all the above-described methods use a coating composition containing a large amount of an organic solvent or water so that a drying means and a large quantity of energy are required for drying the solvent. In addition, the organic solvent gives rise to environmental, handling, safety and economical problems because of its harmfulness to human bodies, a fear of explosion, and expensiveness.

On the other hand, JP-A-62-173295 recommends a method using a solvent-free coating composition, in which a radical polymerizable oligomer whose cured product has a glass transition temperature of not higher than 65° C. is coated on a support and crosslinked by irradiation. However, an attempt of obtaining high recording density by this method has turned out to give a recorded image which is liable to bleeding or lacks storage stability.

SUMMARY OF THE INVENTION

An object of this invention is to provide an image-receiving sheet for thermal dye-transfer recording, which has high gloss and excellent releasability from a coloring material-transferring sheet after thermal dye-transfer recording and provides a recorded image having high density and excellent storage stability.

It has now been found that the above object of this invention is accomplished by an image-receiving sheet for thermal dye-transfer recording of sublimation type, which comprises a support having thereon an image-receiving layer for receiving a transferred image from a coloring material-transferring sheet, wherein said image-receiving layer is a layer formed by coating a substantially solvent-free coating composition comprising (A) a macromonomer dyeable with a sublimable dye and containing a radical polymerizable functional group at one terminal of the molecular chain thereof, said macromonomer being solid at room temperature, dissolved in (B) a liquid radiation-curable monomer and/or oligomer on a support and irradiating the coat with radiation.

DETAILED DESCRIPTION OF THE INVENTION

The terminology "substantially solvent-free" as used herein means that the solid macromonomer (A) is dissolved in the monomer and/or oligomer (B) without the aid of a solvent, not referring to small amounts of solvents present in, for example, additives. The term "solvent" as used herein embraces organic solvents and water.

Macromonomer (A) which can be used in the present invention is a polymer or copolymer having a radical polymerizable functional group (such as a (meth)acryloyl group or an allyl group) introduced into one of the terminals thereof. Particularly preferred polymerizable functional groups include a (meth)acryloyl group exhibiting high reactivity on irradiation of radiation.

A suitable number average molecular weight of macromonomer (A) ranges from about 500 to about 50,000, preferably from 2,000 to 10,000. If it is less than about 500, the recorded image tends to undergo deterioration in storage stability. If it exceeds about 50,000, solubility in monomer and/or oligomer (B) is degraded.

Macromonomers, though having a relatively high molecular weight, should be considered as a polymerizable monomer and are generally employed as precursor for synthesizing graft polymers and, hence, distinguished from usual high polymers such as thermoplastic resins.

As stated above, since macromonomer (A) has a relatively lower molecular weight as compared with usual high polymers such as thermoplastic resins and has a polymerizable functional group, e.g., a (meth)acryloyl group, at one of the terminals thereof, it is easily dissolved in the liquid radiation-curable monomer and/or oligomer, e.g., those mainly comprising a (meth)acrylate compound, thereby readily providing a substantially solvent-free coating composition as used in the present invention.

Macromonomers include solid ones and liquid ones depending on the chemical structure or the molecular weight. As a result of the inventors' investigations, a macromonomer which is liquid at room temperature, when used in an image-receiving layer, has turned out liable to cause recorded image disturbances, such as bleeding, staining, and scratchy fading, with time. On the other hand, in using a macromonomer which is solid at room temperature (e.g., 30° C.), the recorded image has proved free from such disturbances and excellent in storage stability. Therefore, macromonomer (A) to be used in this invention should be solid at room temperature.

Implicit in macromonomers are those having a polymer skeleton comprising various vinyl monomers (e.g., alkyl (meth)acrylates and styrene), oxyethylene, dimethylsiloxane, etc., and the macromonomer which can be used in the present invention should be selected from among those which are solid at room temperature. In particular, it has been found that polymers or copolymers mainly comprising styrene and/or acrylonitrile are excellent in dyeability and storage stability. Particularly preferred among them is macromonomer (A) having a skeleton comprising a styrene-acrylonitrile copolymer in view of its excellent dyeability and storage stability.

When macromonomer (A) is dissolved in monomer and/or oligomer (B), a ratio of (A) to (B) is in the range of from 5:95 to 70:30, preferably from 20:80 to 50:50, by weight. For the purpose of dissolving macromonomer (A), it is desirable that the viscosity of monomer and/or oligomer (B) (or the viscosity of a mixture of more than one monomer and/or oligomer) at 25° C. is as low as possible. To this effect, a preferred viscosity is not higher than 200 cps where a (A):(B) weight ratio is in the range of from 20:80 to 50:50, somewhat varying depending on the (A):(B) ratio.

If the proportion of macromonomer (A) is less than 5% by weight, the recorded image may have poor storage stability. Macromonomer (A), when used in a proportion exceeding 70% by weight, may not be dissolved in monomer and/or oligomer (B) even having a sufficiently low viscosity or, if dissolved, may provide a composition difficult to coat in usual ways due to a high viscosity.

Monomer and/or oligomer (B) which can be used in the present invention contains a radiation-curable ethylenically unsaturated double bond in the molecule thereof. Examples of suitable monomers are:

(a) carboxyl-containing monomers, e.g., ethylenically unsaturated mono- or polycarboxylic acids, and carboxylic acid salt group-containing monomers, e.g., alkali metal salts, ammonium salts or amine salts of the above-described carboxylic acids,
(b) amido-containing monomers typically including ethylenically unsaturated (meth)acrylamides, alkyl-substituted (meth)acrylamides, or vinyl lactams, e.g., N-vinylpyrrolidone,
(c) sulfonic acid-containing monomers, e.g., aliphatic or aromatic vinylsulfonic acids, and sulfonic acid salt group-containing monomers, e.g., alkali metal salts, ammonium salts or amines salts of the above-enumerated sulfonic acids,
(d) hydroxyl-containing monomers, e.g., ethylenically unsaturated ethers,
(e) amino-containing monomers, e.g., dimethylaminoethyl (meth)acrylate-2-vinylpyridine,
(f) quaternary ammonium base-containing monomers,
(g) alkyl esters of ethylenically unsaturated carboxylic acids,
(h) nitrile-containing monomers, e.g., (meth)acrylonitrile,
(i) styrene,
(j) esters of an ethylenically unsaturated alcohol, e.g., vinyl acetate and (meth)allyl acetate,
(k) mono(meth)acrylates of an alkylene oxide-addition polymer of a compound having active hydrogen,
(l) ester group-containing bifunctional monomers typically including diesters between a polybasic acid and an unsaturated alcohol,
(m) bifunctional monomers comprising a diester between an alkylene oxide-addition polymer of a compound having active hydrogen and (meth)acrylic acid,
(n) bisacrylamides, e.g., N,N-methylenebisacrylamide,
(o) bifunctional monomers, e.g., divinylbenzene, divinylethylene glycol, divinylsulfone, divinyl ether, and divinyl ketone,
(p) ester-containing polyfunctional monomers typically including polyesters between a polycarboxylic acid and an unsaturated alcohol,
(q) polyfunctional monomers comprising a polyester between an alkylene oxide-addition polymer of a compound having active hydrogen and (meth)acrylic acid, and
(r) polyfunctional unsaturated monomers, e.g., trivinylbenzene.

Examples of suitable oligomers are:

(a) poly(meth)acrylates of a di- to hexahydric aliphatic, alicyclic or araliphatic alcohol and a polyalkylene glycol,
(b) poly(meth)acrylates of a polyhydric alcohol in which an alkylene oxide is added to a di- to hexahydric aliphatic, alicyclic, araliphatic or aromatic alcohol,
(c) Poly(meth)acryloyloxyalkyl phosphates,
(d) polyester poly(meth)acrylates,
(e) epoxy poly(meth)acrylates,
(f) polyurethane poly(meth)acrylates,
(g) polyamide poly(meth)acrylates,
(h) organo(poly)siloxane poly(meth)acrylates, (i) vinyl or diene type low polymers having a (meth)acryloyloxy group at the side chains and/or terminals thereof, and (j) the oligomers (a) to (i) enumerated above, modified with an oligoester (meth)acrylate.

These monomers and oligomers can be used either individually or as a mixture of two or more thereof. A mixture of a monofunctional monomer, as a main component, and a polyfunctional monomer and/or oligomer gives good results. In this case, a mixing ratio must be selected properly because too a high proportion of the polyfunctional monomer and/or oligomer brings about too a high curing density to reduce the image density, and too a high proportion of the monofunctional monomer results in reduction of image storage stability or coating film strength.

It is preferable that these monomers and/or oligomers have high dissolving capability with macromonomer (A). It is also preferable to select monomer(s) and/or oligomer(s) (B) to be used from those having excellent dyeability. For example, though not for limitation, radiation-curable monofunctional monomers having a structure represented by formula (I) shown below are excellent in dyeability and preferably used as part of radiation-curable monomer and/or oligomer (B).

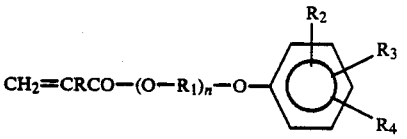

(I)

wherein R represents a hydrogen atom or a methyl group; $R_1$ represents an alkylene group having from 1 to about 10 carbon atoms; $R_2$, $R_3$, and $R_4$, each represents a hydrogen atom, an alkyl group having from 1 to about 20 carbon atoms, a phenyl group, or a substituted phenyl group; and n represents an integer of from 1 to 30.

Where monomer (B) of formula (I) is used, if its amount is large, it may give off strong odor after the curing or deteriorates storage stability of the recorded image. However, it has been found that a combined use of N-vinylpyrrolidone in an amount of, e.g., about 1 to 30% by weight based on the total composition reduces the odor after the curing and improves storage stability. While the reasons are not necessarily clear, N-vinylpyrrolidone has a high glass transition point after the curing and assumably controls the composition after the curing not to have too a low glass transition point. Also, N-vinylpyrrolidone has good copolymerizability with other monomers, thus assumably improving the curing properties of the composition. Further, N-vinylpyrrolidone has a very low viscosity and a high dissolving power and is therefore effective to decrease the viscosity of the composition. If the amount of the N-vinylpyrrolidone is less than 1% by weight, these effects become small. If it exceeds 30% by weight, the image density may be reduced, or the odor may become stronger.

It is also preferable to use a radiation-curable silicon compound as part of monomer and/or oligomer (B). Such a silicon compound undergoes polymerization and crosslinking with macromonomer (A) and other radiation-curable monomers and/or oligomers, whereby the image-receiving layer is endowed with the excellent properties possessed by the silicon compound, i.e., heat resistance, slip properties, and release properties, and is thus prevented from blocking.

The radiation-curable silicon compound stated above includes organo(poly)siloxane (poly)(meth)acrylates obtained by introducing at least one radiation-reactive group, e.g., a (meth)acryloyl group, into organo(poly)siloxane compounds.

If desired, the coating composition may further contain radiation-non-curable resins, in particular, thermoplastic resins dyeable with the sublimable dye, as long as they do not impair the desired effects of the present invention, such as blocking resistance. Examples of such resins include polymers or copolymers of a vinyl monomer such as styrene, vinyltoluene, acrylic acid esters, methacrylic acid esters, acrylonitrile, vinyl chloride, vinyl acetate, etc.; condensation polymers such as polyesters, polyamides, polycarbonates, polysulfones, epoxy resins, polyurethanes, etc.; and cellulosic resins.

In order to further improve releasability of the image-receiving sheet from the ink sheet, the image-receiving layer may contain a small amount of a release agent other than the aforementioned ones. Examples of suitable release agents include solid waxes, e.g., polyethylene wax, amide wax, and Teflon® powder; fluorine type, silicon type or phosphate type surface active agents; and silicone oil.

If desired, the coating composition may still further contain various auxiliary agents such as dyes, pigments, wetting agents, defoaming agents, dispersing agents, antistatic agents, levelling agents, lubricating agents, etc. so far as the desired effects of this invention are not hindered thereby.

The support of the image-receiving sheet according to the present invention is not particularly limited as far as it is a flexible sheet, including paper sheets, e.g., generally known coated paper, wood-free paper, synthetic paper, metalized paper, and colored paper; synthetic resin films, e.g., a polyethylene terephthalate film, a polypropylene film, and a polyethylene film; metal foils, e.g., a copper foil, an iron foil, and an aluminum foil; cloth; a non-woven cloth. In using a support highly permeable to the coating composition for forming an image-receiving layer, an appropriate barrier layer is preferably provided on the support. It is also preferable to provide an appropriate interlayer to endow the support with surface smoothness, cushioning properties and heat insulating properties thereby aiding effective transfer of a dye to the image-receiving layer.

The coverage of the coating composition for the image-receiving layer usually ranges from about 0.1 to 50 g/m$^2$, preferably from about 1 to 20 g/m$^2$, on a solid basis. If it is less than about 0.1 g/m$^2$, the desired effects cannot be obtained; and a coverage more than 50 g/m$^2$ produces no further improvement and has no economical merit.

The method of coating the coating composition is not particularly restricted, and any commonly employed coating means such as a bar coater, a roll coater, an air knife coater, and a gravure coater, can be used appropriately. For the purpose of improving wettability of the surface to be coated or improving adhesion to the coated layer, it is possible to pretreat the surface of the support by a corona discharge treatment, a radiation treatment or a plasma treatment.

The radiation for curing the coating composition includes ultraviolet rays, $\alpha$-rays, $\beta$-rays, $\gamma$-rays, X-rays, and electron beams. $\alpha$-rays, $\beta$-rays, $\gamma$-rays, and X-rays being accompanied by a danger to human bodies, ultraviolet rays and electron beams which are easy to handle and wide spread in industry are preferred. In particular, an electron beam curing system is more preferred because of not only higher productivity than an ultraviolet ray radiation curing system but freedom from problems, such as generation of odors, coloration, and reduction of storage stability, arising from a photo-initiator used in the ultraviolet ray curing system.

In using electron beams, the exposed irradiation dose suitably ranges from about 0.1 to 20 Mrad. With a dose of less than 0.1 Mrad, sufficient radiation effects may not be obtained. With a dose exceeding 20 Mrad, there is a fear for paper supports or some synthetic resin film supports to be impaired.

Suitable electron beam radiation systems include a scanning system, a curtain beam system, a broad beam system, and the like. The accelerating voltage in the electron beam radiation suitably ranges from about 100 to 300 kV.

In using ultraviolet rays, the coating composition must contain a photo-initiator. Suitable examples of photo-initiators include thioxanthone, benzoin, benzoin alkyl ether xanthones, dimethylxanthone, benzophenone, anthracene, 2,2-diethoxyacetophenone, benzyl dimethyl ketal, benzil, diphenyl disulfide, anthraquinone, 1-chloroanthraquinone, 2-ethylanthraquinone, 2-t-butylanthraquinone, N,N'-tetraethyl-4,4'-diaminobenzophenone, 1,1-dichloroacetophenone, etc. and appropriate mixtures of two or more thereof.

The photo-initiator is preferably added in an amount of from about 0.2 to 10% by weight, more preferably from about 0.5 to 5% by weight, based on the total composition. If desired, curing of the photoinitiator-containing composition can be accelerated by additionally incorporating a tertiary amine, e.g., triethanolamine, 2-dimethylaminoethanol, dimethylaminobenzoic acid, isoamyl dimethylaminobenzoate, dioctylaminobenzoic acid, and lauryl dimethylaminobenzoate, in an amount of from about 0.05 to 3% by weight based on the total composition.

Suitable radiation sources of ultraviolet rays include about 1 to 50 ultraviolet lamps (including low-, medium- or high-pressure mercury vapor lamps having a working pressure of from about few mmHg to about 10 atms.), xenon lamps, and tungsten lamps. Ultraviolet rays having an intensity between about 5,000 $\mu W/cm^2$ and about 8,000 $\mu W/cm^2$ are preferably used.

The reason for the above-described excellency of the image-receiving sheet according to the present invention has not yet been elucidated, but probable assumptions are given in the following paragraph.

Macromonomer (A) having dyeability and radiation-curable monomer and/or oligomer (B) undergo polymerization and crosslinking on application of radiation to form a three-dimensional crosslinked structure in parts which is believed to contribute to prevention of blocking. In the reaction of macromonomer (A), it is assumed that only one of the terminals thereof takes part in polymerization to form a comb structure (i.e., grafted structure), while the other terminal remaining free. On heating the coloring material-transferring sheet with a thermal head, the sublimable dye in the sheet is sublimated and, at the same time, the image-receiving layer is also heated. It is assumed that the comb structure is thus relaxed to provide sites in which the sublimable dye is trapped. As the image-receiving layer is cooled, the comb structure seems to get dense again, and the dye is enclosed therein and protected from diffusion. As a result, the recorded image seems to be prevented from disturbances, such as bleeding and staining.

The image-receiving sheet for thermal dye-transfer recording according to the present invention is excellent in not only the above-mentioned performance properties but also productivity and safety owing to the use of the substantially solvent-free composition. In addition, because the preparation of the image-receiving layer does not involve evaporation of a solvent, the resulting image-receiving sheet has high gloss.

The present invention is now illustrated in greater by way of the following Examples and Comparative Examples, but it should be understood that the present invention is not construed as being limited thereto. Unless otherwise specified, all the parts and percents are by weight.

EXAMPLE 1

A coating composition consisting of 40 parts of a macromonomer having a number average molecular weight of about 6,000 which was powderous at room temperature and had an oligomer skeleton comprising a styreneacrylonitrile copolymer with a methacryloyl group bonded to one of the terminals thereof, ("Macromonomer AN-6" produced by Toagosei Chemical Industry Co., Ltd., hereinafter referred to as AN-6) as macromonomer (A), 40 parts of tolyloxyethyl acrylate (viscosity at 25° C.: 17 cps, hereinafter abbreviated as TEA) as a radiation-curable monofunctional monomer, and 20 parts of polyethylene glycol diacrylate ("New Frontier® PE200" produced by Dai-ichi Kogyo Seiyaku Co., Ltd.; viscosity at 25° C.: 18 cps; hereinafter referred to as PE200) as a radiation-curable bifunctional monomer was coated on 150 μm thick polypropylene-based synthetic paper having been treated with corona discharge to a dry coverage of 5 $g/m^2$. The coat was then irradiated with 5 Mrad of electron beams using an electron beam accelerator ("Electrocurtain CB-150" manufactured by Energy Science Inc.) to obtain an image-receiving sheet for thermal dye-transfer recording.

EXAMPLE 2

An image-receiving sheet for dye-transfer recording was obtained in the same manner as in Example 1, except for replacing AN-6 with a macromonomer having a number average molecular weight of about 6,000 which was powderous at room temperature and had an oligomer skeleton comprising polystyrene with a methacryloyl group bonded to one of the terminals thereof ("Macromonomer AS-6" produced by Toagosei Chemical Industry Co., Ltd., hereinafter referred to as AS-6).

EXAMPLE 3

An image-receiving sheet for dye-transfer recording was obtained in the same manner as in Example 1, except for replacing AN-6 with a macromonomer having a weight average molecular weight of about 13,000 which was powderous at room temperature and had an oligomer skeleton comprising polystyrene with a methacryloyl group bonded to one of the terminals thereof ("Macromer 13K-RC" produced by Sartomer Corp., hereinafter referred to as 13K-RC).

EXAMPLE 4

An image-receiving sheet for dye-transfer recording was obtained in the same manner as in Example 1, except for replacing AN-6 with a macromonomer having a number average molecular weight of about 4,500 which was powderous at room temperature and had an oligomer skeleton comprising a styrene-acrylonitrile copolymer with a methacryloyl group bonded to one of the terminals thereof ("Macromonomer AN-4" produced by Toagosei Chemical Industry Co., Ltd., hereinafter referred to as AN-4).

EXAMPLE 5

An image-receiving sheet for dye-transfer recording was obtained in the same manner as in Example 1, except for replacing AN-6 with a macromonomer having a number average molecular weight of about 3,500 which was powderous at room temperature and had an oligomer skeleton comprising polystyrene with a methacryloyl group bonded at one of the terminals thereof, ("Macromonomer AS-4" produced by Toagosei Chemical Industry Co., Ltd., hereinafter referred to as AS-4).

COMPARATIVE EXAMPLE 1

An image-receiving sheet for dye-transfer recording was obtained in the same manner as in Example 1, except for replacing AN-6 with a liquid macromonomer having a number average molecular weight of about 6,000 and comprising an oligomer skeleton comprising polybutyl acrylate with a methacryloyl group being bonded to one of the therminals thereof ("Macromonomer AB-6" produced by Toagosei Industry Co., Ltd., hereinafter referred to as AB-6).

EXAMPLES 6 TO 11

An image-receiving sheet for dye-transfer recording was obtained in the same manner as in Example 1, except for using each of the coating compositions shown in Table 1 below.

EXAMPLE 12

An image-receiving sheet was obtained in the same manner as in Example 1, except that the coating composition further contained 0.2% of a radiation-curable silicon compound ("EBECRYL® 450", a tradename of silicon diacrylate produced by Daisel UCB K.K., hereinafter referred to as EB350).

EXAMPLE 13

An image-receiving sheet was obtained in the same manner as in Example 1, except that the coating composition further contained 0.2% of a radiation-curable silicon compound ("Macromonomer AK-5", a tradename of a silicon macromonomer comprising a polysiloxane compound having a methacryloyl group at one of the terminals thereof, produced by Toagosei Industry Co., Ltd., hereinafter referred to as AK-5).

EXAMPLES 14 TO 18

An image-receiving sheet was obtained in the same manner as in Example 1, except for using each of the coating compositions shown in Table 1 below. In this case, the abbreviation "AA-6" as used refers to "Macromonomer AA-6", a tradename of a macromonomer having a number average molecular weight of about 6,000, which was solid at room temperature and had a polymethyl methacrylate skeleton with a methacryloyl group bonded to one of the terminals thereof, produced by Toagosei Chemical Industry Co., Ltd.

COMPARATIVE EXAMPLE 2

An image-receiving sheet was obtained by coating a coating composition comprising 100 parts of a polyester resin ("Vylon® 200" produced by Toyobo Co., Ltd.) dissolved in 500 parts of a 1:1 (by volume) mixture of toluene and methyl ethyl ketone on the same support as used in Example 1 to a dry coating weight of 5 g/m$^2$, followed by drying at 120° C. for 2 minutes.

COMPARATIVE EXAMPLE 3

An image-receiving sheet was obtained in the same manner as in Comparative Example 2, except for using a coating composition comprising 100 parts of a polyester resin "Vylon® 200" and 2 parts of a silicone oil ("KP-358" produced by Shin-Etsu Chemical Industry Co., Ltd.) dissolved in 500 parts of a 1:1 (by volume) mixture of toluene and methyl ethyl ketone.

COMPARATIVE EXAMPLE 4

An image-receiving sheet was obtained in the same manner as in Example 1, except for using a coating composition comprising 50 parts of tolyloxyethyl acrylate as a radiation-curable monofunctional monomer, 10 parts of N-vinylpyrrolidone, and 40 parts of polyethylene glycol diacrylate "New Frontier® PE 200" as a radiation-curable bifunctional monomer.

COMPARATIVE EXAMPLE 5

An image-receiving sheet was obtained in the same manner as in Example 1, except for using polypropylene glycol diacrylate ("NK Ester APG400" produced by Shin Nakamura Kagaku K.K.) as a coating composition.

EXAMPLES 19 TO 22

An image-receiving sheet was obtained in the same manner as in Example 1, except for using each of the coating compositions shown in Table 2 below. In this case, each of the abbreviations "M101", "M102", "M111" and "R644" as used refers to as follows.

"M101" refers to "Aronix® M101", a tradename of Toagosei Chemical Industry Co., Ltd., having a viscosity of 16 cps at 25° C. and represented by formula (II):

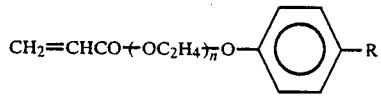

(II)

wherein n is about 2, and R is H.

"M102" refers to "Aronix® M102", a tradename of Toagosei Chemical Industry Co., Ltd., having a viscosity of 30 cps at 25° C. and represented by the foregoing formula (II) wherein n is about 4, and R is H.

"M111" refers to "Aronix® M111", a tradename of Toagosei Chemical Industry Co., Ltd., having a viscosity of 70 cps at 25° C. and represented by the foregoing formula (II) wherein n is about 1, and R is $C_9H_{19}$.

"R644" refers to "KAYARAD® R644", a tradename of Nippon Kayaku Co., Ltd., having a viscosity of 60 cps at 25° C. and represented by the following formula:

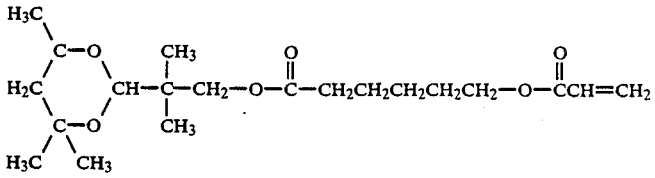

Each of the image-receiving sheets obtained in Examples 1 to 22 and Comparative Examples 1 to 5 was evaluated for performance properties as follows.

An ink sheet for thermal dye-transfer recording (an ink sheet using a sublimable dye for Hitachi color video printer) was superposed on the image-receiving sheet, and thermal dye-transfer recording was conducted using a color video printer ("Hitachi Color Video Printer VY-50" manufactured by Hitachi, Ltd.). The recorded image density, blocking (fusion between the image-receiving sheet and the ink sheet), and recorded image storage stability were evaluated as follows. The results obtained are shown in Tables 1 and 2 below.

(1) Recorded Image Density:

The maximum density of the blue image was measured with a Macbeth Densitometer. The higher the measured value, the higher the recorded density.

(2) Blocking:

Blocking was judged according to the following rating system:

| | |
|---|---|
| Excellent | No fusion was observed between the image-receiving sheet and the ink sheet. Both sheets were easily releasable from each other after dye-transfer recording. |
| Good | Substantially no fusion was observed between the image-receiving sheet and the ink sheet. |
| Medium | Slight fusion was observed, but acceptable for practical use. |
| Poor | Considerable fusion occurred. |

(3) Storage Stability:

The blue image was preserved at 20° C. and 65% RH (relative humidity) for 1 month, and bleeding and staining of the image were visually observed and judged according to the following rating system:

| | |
|---|---|
| Excellent | Neither bleeding nor staining was observed at all. |
| Good | Substantially no bleeding or staining was observed. |
| Medium | Slight bleeding or staining was observed, but acceptable for practical use. |
| No good | Bleeding or staining was observed, and unacceptable for practical use. |
| Poor | Considerable bleeding and staining were observed. |

TABLE 1

| | Macromonomer (A) | | | | | | Monomer and/or Oligomer (B) Monofunctional Monomer | | | Polyfunctional Monomer/Oligomer | | | |
|---|---|---|---|---|---|---|---|---|---|---|---|---|---|
| Example No. | AN-6 | AS-6 | 13K-RC | AN-4 | AS-4 | AA-6 | TEA | PHE*1 | NVP*2 | PE200 | HDDA*3 | TMPTA*4 | PETA*5 |
| Example 1 | 40 | | | | | | | | | | | | |
| Example 2 | | 40 | | | | | 40 | | | 20 | | | |
| Example 3 | | | 40 | | | | 40 | | | 20 | | | |
| Example 4 | | | | 40 | | | 40 | | | 20 | | | |
| Example 5 | | | | | 40 | | 40 | | | 20 | | | |
| Example 6 | 40 | | | | | | 30 | | 10 | 20 | | | |
| Example 7 | 35 | | | | | | 45 | | | | 20 | | |
| Example 8 | 35 | | | | | | 40 | | 10 | | | 15 | |
| Example 9 | | | 40 | | | | 30 | | 10 | 15 | | | |
| Example 10 | 30 | | | | | | 40 | | 10 | 15 | | | |
| Example 11 | | | 50 | | | | 35 | | 5 | 10 | | | |
| Example 12 | 40 | | | | | | 40 | | | 20 | | | |
| Example 13 | 40 | | | | | | 40 | | | 20 | | | |
| Example 14 | | | | 20 | | 15 | 45 | | 10 | | | | 10 |
| Example 15 | 35 | | | | | | | 45 | 10 | | | | 10 |
| Example 16 | | | | | 60 | | | 25 | 10 | | | 5 | |
| Example 17 | | | | | | 30 | 50 | | 15 | | | | 5 |
| Example 18 | 35 | | | | | | 50 | | 15 | | | | |
| Comparative Example 1 | | | | | | | | | | | | | |
| Comparative Example 2 | | | | | | | | | | | | | |
| Comparative Example 3 | | | | | | | | | | | | | |
| Comparative Example 4 | | | | | | | 50 | | 10 | 40 | | | |
| Comparative Example 5 | | | | | | | | | | | | | |

| | Monomer and/or Oligomer (B) Radiation Curing Silicone | | | | Performance Quality | | |
|---|---|---|---|---|---|---|---|
| Example No. | X-62-7176*6 | EB350 | AK-5 | Viscosity at 25° C. (cps) | Recorded Density | Blocking | Storage Stability |

TABLE 1-continued

| | | | | | | | |
|---|---|---|---|---|---|---|---|
| Example 1 | | | | 17 | 1.65 | Good | Good |
| Example 2 | | | | 17 | 1.68 | Good | Medium |
| Example 3 | | | | 17 | 1.67 | Good | Medium |
| Example 4 | | | | 17 | 1.63 | Good | Good |
| Example 5 | | | | 17 | 1.65 | Good | Medium |
| Example 6 | | | | 15 | 1.60 | Good | Excellent |
| Example 7 | | | | 14 | 1.60 | Good | Good |
| Example 8 | | | | 40 | 1.55 | Good | Excellent |
| Example 9 | 5 | | | 28 | 1.63 | Excellent | Good |
| Example 10 | 5 | | | 26 | 1.65 | Excellent | Excellent |
| Example 11 | | | | 16 | 1.68 | Good | Good |
| Example 12 | | 0.2 | | 17 | 1.65 | Excellent | Good |
| Example 13 | | | 0.2 | 17 | 1.65 | Excellent | Good |
| Example 14 | | | | 120 | 1.55 | Good | Excellent |
| Example 15 | | | | 120 | 1.63 | Good | Excellent |
| Example 16 | | | | 21 | 1.60 | Good | Good |
| Example 17 | | | | 63 | 1.50 | Good | Good |
| Example 18 | | | | 14 | 1.68 | Medium | Medium |
| Comparative 1 Example | | | | | | | |
| Comparative 2 Example | | | | | —*7 | Poor | — |
| Comparative 3 Example | | | | | 1.60 | Good | No good |
| Comparative 4 Example | | | | | 1.35 | Good | Poor |
| Comparative 5 Example | | | | | 1.45 | Good | Poor |

Note:
*1Phenoxyethyl acrylate (viscosity at 25° C.: 9 cps)
*2N-vinylpyrrolidone (viscosity at 25° C.: 2 cps)
*3Hexanediol diacrylate (viscosity at 25° C.: 6 cps)
*4Trimethylolpropane triacrylate (viscosity at 25° C.: 120 cps)
*5Pentaerythritol triacrylate (viscosity at 25° C.: 700 cps)
*6A tradename of a radiation-curable silicon compound, produced by Shin-Etsu Chemical Industry Co., Ltd.; viscosity at 25° C.: 180 cps)
*7Unmeasurable due to serious blocking.

TABLE 2

| Example No. | Macro-Monomer (A) AN-6 | Monomer (B) Mono-functional Monomer | | Monomer (B) Polyfunctional Monomer PETA | Monomer (B) Viscosity at 25° C. (cps) | Performance Quality Recorded Density | Performance Quality Blocking | Performance Quality Storage Stability |
|---|---|---|---|---|---|---|---|---|
| 19 | 35 | M101 | 45 | 10 | 120 | 1.65 | Good | Excellent |
| | | NVP | 10 | | | | | |
| 20 | 35 | M102 | 45 | 10 | 130 | 1.65 | Good | Excellent |
| | | NVP | 10 | | | | | |
| 21 | 35 | M111 | 45 | 10 | 155 | 1.62 | Good | Excellent |
| | | NVP | 10 | | | | | |
| 22 | 35 | R644 | 45 | 10 | 150 | 1.55 | Good | Excellent |
| | | NVP | 10 | | | | | |

As is apparent from the results of Tables 1 and 2, each of the image-receiving sheets according to the present invention provides a high recording density, undergoes no blocking with the ink sheet, and exhibits excellent storage stability, thus being of high commercial value. Because substantially no solvent is used in the preparation of the coating composition, not only does the image-receiving sheet have high gloss, but production and safety advantages can be obtained.

While the invention has been described in detail and with reference to specific embodiments thereof, it will be apparent to one skilled in the art that various changes and modifications can be made therein without departing from the spirit and scope thereof.

What is claimed is:

1. An image-receiving sheet for receiving a transferred image from a donor sheet carrying a sublimable dye, which image-receiving sheet comprises a support having thereon an image-receiving layer for receiving said transferred image from said donor sheet, wherein said image-receiving layer is a layer formed by coating on a support a substantially solvent-free coating composition comprising a macromonomer (A) dyeable with a sublimable dye and containing a radical polymerizable functional group at one terminal of the molecular chain thereof and having a number average molecular weight of from about 500 to about 50,000, said macromonomer being solid at room temperature, dissolved in a liquid radiation-curable monomer and/or oligomer (B) containing a radiation-curable ethylenically unsaturated double bond in the molecule thereof, with a weight ratio of said macromonomer (A) to said monomer and/or oligomer (B) being in the range of from 5:95 to 70:30, and irradiating the coat with radiation.

2. An image-receiving sheet as claimed in claim 1, wherein said macromonomer (A) comprises a polymer or copolymer skeleton mainly comprising styrene and/or acrylonitrile with a (meth)acryloyl group being bonded to one terminal of the molecular chain thereof.

3. An image-receiving sheet as claimed in claim 2, wherein said macromonomer (A) has a skeleton of a styrene-acrylonitrile copolymer with a (meth)acryloyl group being bonded to one terminal of the molecular chain thereof.

4. An image-receiving sheet as claimed in claim 1, wherein said monomer and/or oligomer (B) comprise at least one monofunctional monomer and at least one polyfunctional a monomer and/or an oligomer.

5. An image-receiving sheet as claimed in claim 4, wherein said monofunctional monomer comprises a structure represented by formula:

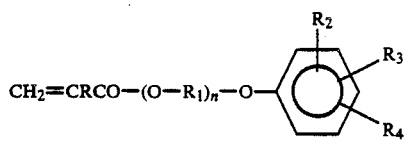

(I)

wherein R represents a hydrogen atom or a methyl group; $R_1$ represents an alkylene group having from 1 to about 10 carbon atoms; $R_2$, $R_3$, and $R_4$, each represents a hydrogen atom, an alkyl group having from 1 to about 20 carbon atoms, a phenyl group, or a substituted phenyl group; and n represents an integer of from 1 to 30.

6. An image-receiving sheet as claimed in claim 5, wherein said monofunctional monomer comprises N-vinylpyrrolidone.

7. An image-receiving sheet as claimed in claim 4, wherein said monofunctional monomer comprises N-vinylpyrrolidone.

8. An image-receiving sheet as claimed in claim 1, wherein a weight ratio of macromonomer (A) to monomer and/or oligomer (B) ranges from 20:80 to 50:50, and the monomer and/or oligomer (B) has a viscosity of not more than 200 cps at 25° C.

* * * * *